US008631884B2

(12) United States Patent
Lyon et al.

(10) Patent No.: US 8,631,884 B2
(45) Date of Patent: Jan. 21, 2014

(54) PRESSURE REVERSING VALVE ASSEMBLY FOR A DOWN-THE-HOLE PERCUSSIVE DRILLING APPARATUS

(75) Inventors: Leland H. Lyon, Roanoke, VA (US); Warren Thomas Lay, Catawba, VA (US)

(73) Assignee: Center Rock Inc., Berlin, PA (US)

( * ) Notice: Subject to any disclaimer, the term of this patent is extended or adjusted under 35 U.S.C. 154(b) by 271 days.

(21) Appl. No.: 12/794,314

(22) Filed: Jun. 4, 2010

(65) Prior Publication Data

US 2011/0297447 A1 Dec. 8, 2011

(51) Int. Cl.
*E21B 4/14* (2006.01)

(52) U.S. Cl.
USPC ..... 175/296

(58) Field of Classification Search
USPC ..... 175/296, 61, 65, 92
See application file for complete search history.

(56) References Cited

U.S. PATENT DOCUMENTS

| | | | | |
|---|---|---|---|---|
| 5,085,284 | A | 2/1992 | Fu | |
| 5,301,761 | A | 4/1994 | Fu et al. | |
| RE36,848 | E * | 9/2000 | Bui et al. | 175/65 |
| 6,135,216 | A | 10/2000 | Lyon et al. | |
| 6,237,704 | B1 | 5/2001 | Lay | |
| 6,799,641 | B1 | 10/2004 | Lyon | |
| 7,159,676 | B2 | 1/2007 | Lyon | |
| 7,467,675 | B2 | 12/2008 | Lay | |
| 2005/0034899 | A1 | 2/2005 | Lyon | |
| 2007/0278010 | A1 | 12/2007 | Lay | |

FOREIGN PATENT DOCUMENTS

WO 03042490 A1 5/2003

OTHER PUBLICATIONS

Swedish Office Action issued Mar. 7, 2012 in Swedish Application No. 1150504-7.
Canadian Office Action issued Oct. 3, 2012 in Canadian Application No. 2,742,024.
Canadian Office Action issued Mar. 25, 2013 in Canadian Application No. 2,742,024.
Office Action issued Sep. 17, 2013 in Australian Patent Application No. 2011202481.
Office Action issued Oct. 4, 2013 in Chilean Patent Application No. 1326-2011.

* cited by examiner

*Primary Examiner* — Brad Harcourt
(74) *Attorney, Agent, or Firm* — Kim Winston LLP

(57) ABSTRACT

A pressure reversing valve for a down-the-hole percussive drilling ("DHD") apparatus has a first valve pressure surface, a second valve pressure surface and a third valve pressure surface. The first valve pressure surface engages an internal surface of a housing of the DHD hammer. The second valve pressure surface is in communication with a high pressure port of the DHD hammer. The third valve pressure surface is in communication with a passageway that extends through a distributor within the DHD hammer. The valve also includes a valve passageway that extends through the valve and which is in communication with a first volume of the DHD hammer. The first volume is formed by surfaces of the distributor and the third valve pressure surface.

20 Claims, 8 Drawing Sheets

PRESSURE REVERSING VALVE ASSEMBLY FOR A DOWN-THE-HOLE PERCUSSIVE DRILLING APPARATUS

BACKGROUND OF THE INVENTION

The present invention relates to a down-the-hole drill ("DHD") hammer. In particular, the present invention relates to a percussive DHD hammer having a pressure sensitive valve for controlling a drive chamber of the DHD hammer.

Conventional pressure sensitive valves are designed to provide for the efficient use of working fluids to actuate the DHD hammer. However, such conventional pressure sensitive valves are typically complicated by the need for a complex porting system within a distributor of the DHD hammer. Thus, there is still a need for a pressure sensitive valve that can efficiently use working fluids without the need for a compatible complex distributor. The present invention satisfies such deficiencies in conventional pressure sensitive valves.

BRIEF SUMMARY OF THE INVENTION

In accordance with a first preferred embodiment, the present invention provides a pressure reversing valve for a down-the-hole drilling apparatus. The apparatus includes a first, a second and a third valve pressure surface. The first valve pressure surface engages an internal surface of a housing of the down-the-hole drilling apparatus and is in communication with a drive chamber of the down-the-hole drilling apparatus. The second valve pressure surface is in communication with a high pressure port of the down-the-hole drilling apparatus. The third valve pressure surface is in communication with a passageway extending through a distributor within the housing. The apparatus also includes a valve passageway extending through the pressure reversing valve which is in communication with a first volume of the down-the-hole drilling apparatus. The first volume is formed by surfaces of the distributor and the third valve pressure surface.

In accordance with a second preferred embodiment, the present invention provides a pressure reversing valve assembly for a down-the-hole drilling apparatus comprising a housing, a distributor and a valve. The distributor is housed within the housing and includes an exhaust stem, a central bore extending axially through the distributor, and a plurality of apertures extending radially through the exhaust stem. The valve is sealingly engaged with the exhaust stem and movable between an open position and a closed position. In the open position, a high pressure port is in communication with a drive chamber. In the closed position, the high pressure port is sealed off from the drive chamber. The valve includes a first valve pressure surface, a second valve pressure surface, a third valve pressure surface, and a valve passageway that extends through the valve and is in communication with a first volume of the down-the-hole drilling apparatus. The first volume is formed by surfaces of the distributor and at least one of the first, second and third valve pressure surfaces.

In accordance with a third preferred embodiment, the present invention provides a pressure reversing valve assembly for a down-the-hole drilling apparatus comprising a distributor and a valve. The distributor includes an upper body portion, a lower body portion having a side wall, and an exhaust stem extending distally from the lower body portion. The valve includes a base, a side wall and a valve passageway. The base has a proximal surface, a distal surface and a thru hole for receiving the exhaust stem. The side wall extends from the base and has an inner side surface and an outer side surface. The valve passageway extends through the valve and is in communication with an area formed by the distributor and the proximal surface of the base.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
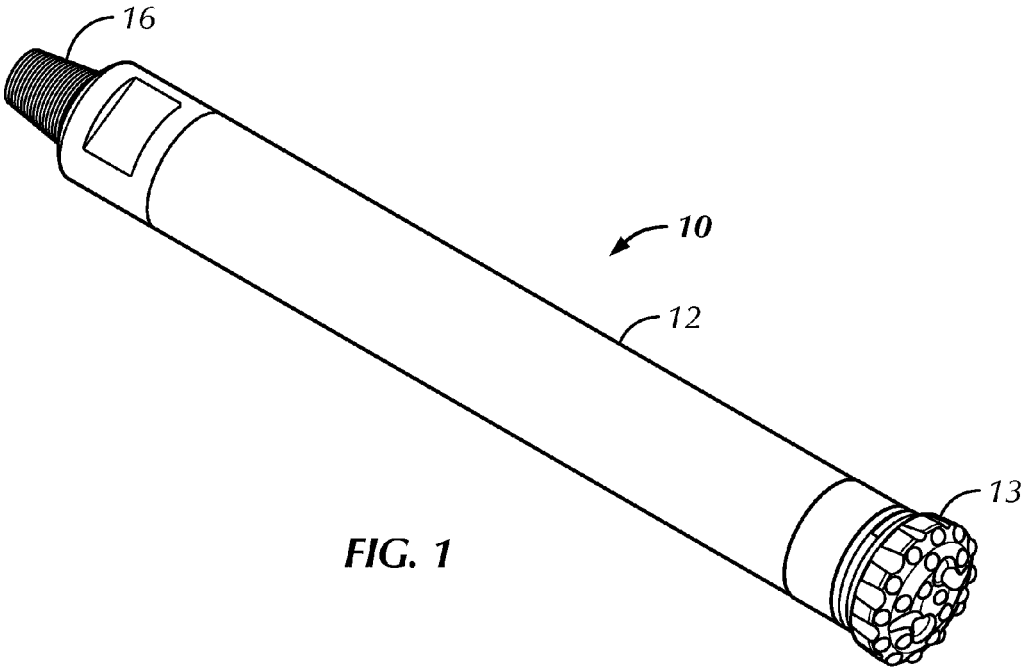
FIG. 1 is a perspective view of a DHD hammer in accordance with a first preferred embodiment of the present invention.

Certain terminology is used in the following description for convenience only and is not limiting. The words "right," "left," "upper," and "lower" designate directions in the drawings to which reference is made. For purposes of convenience, "distal" is generally referred to as toward the drill bit end of the DHD hammer, and "proximal" is generally referred to as toward the backhead end of the DHD hammer as illustrated in FIG. 1. Additionally, the term "a," as used in the specification, means "at least one." The terminology includes the words above specifically mentioned, derivatives thereof, and words of similar import.

Figure 13:
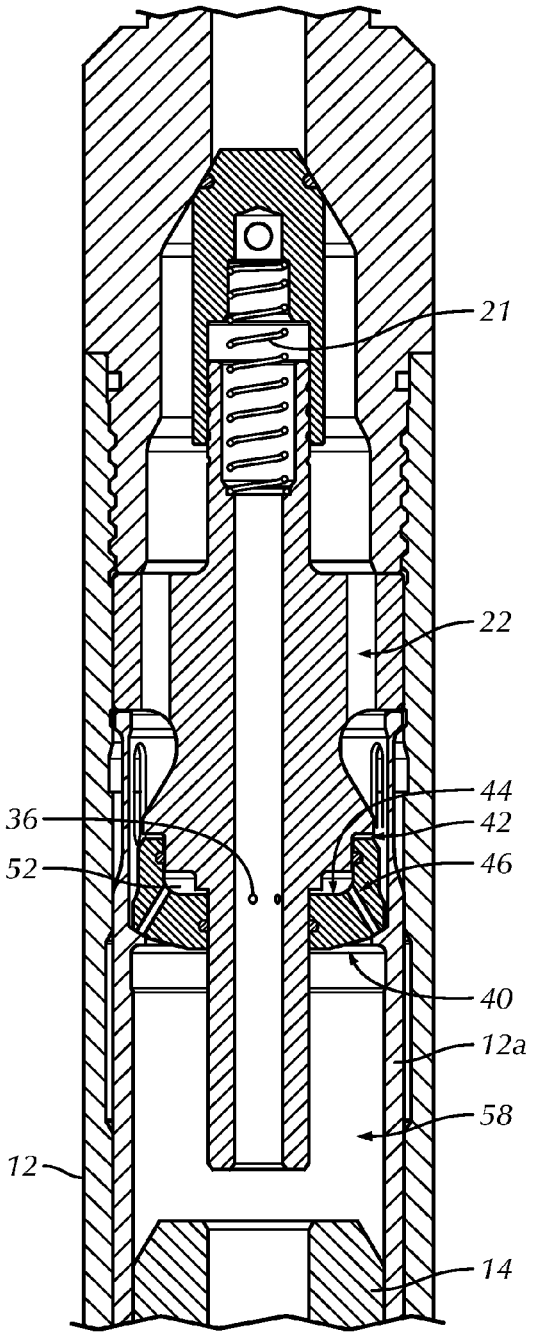
FIG. 13 is a partial, cross-sectional, elevational view of the DHD hammer of FIG. 1 with the valve in a closed position and the cross-section taken through the through holes of the distributor.

In a first preferred embodiment, the present invention provides a DHD hammer 10, as best shown in FIGS. 1-14. The DHD hammer 10 generally includes a housing 12, drill bit 13, a piston 14, a backhead 16 and a check valve assembly 18, as best shown in FIGS. 1, 11 and 13. The backhead 16 and the piston 14 are assembled to the housing 12 in a conventional manner that is well known to those skilled in the art. As such, a detailed discussion of the assembly of the backhead 16 and the piston 14 to the DHD hammer 10 is not necessary for complete understanding of the present invention.

Figure 2:
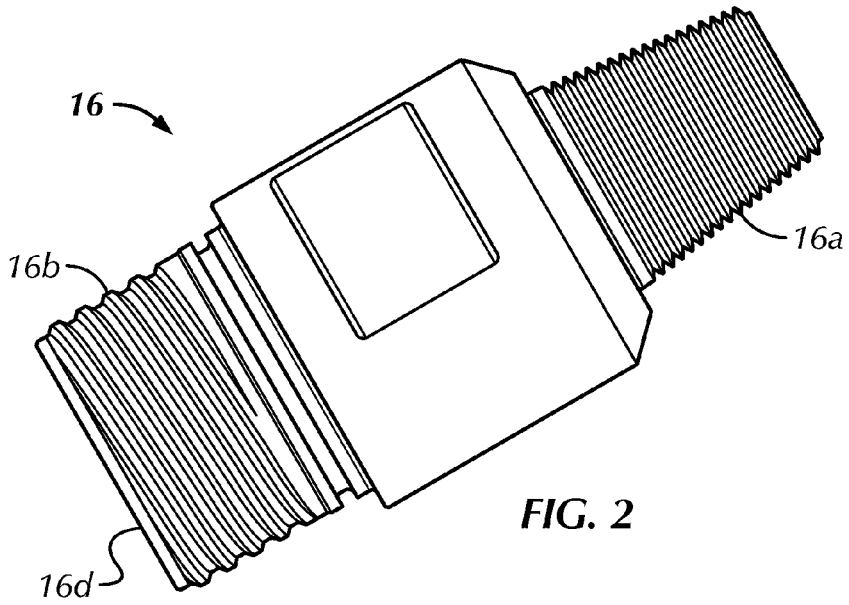
FIG. 2 is an enlarged perspective view of a backhead of the DHD hammer of FIG. 1.
Figure 3:
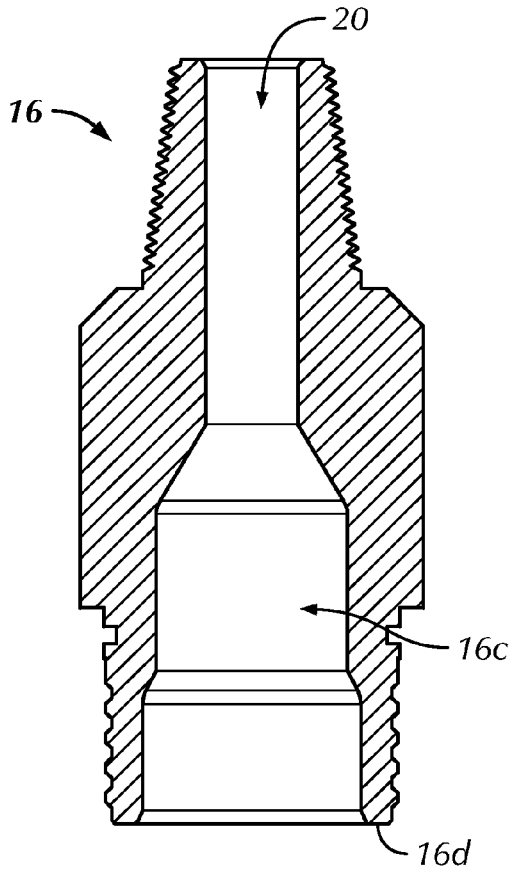
FIG. 3 is a cross-sectional, elevational view of the backhead of FIG. 2.

However, the backhead 16 is configured as shown in FIGS. 2 and 3 with a tool-joint connection for connecting to a drill string (not shown). The tool-joint connection includes male threads 16*a*. The backhead 16 also includes threads 16*b* for threadedly connecting to the housing 12 (FIG. 11). A supply port 20 extends through the backhead 16 and is in communication with an interior 16*c* of the backhead 16 (FIG. 3).

Figure 4:
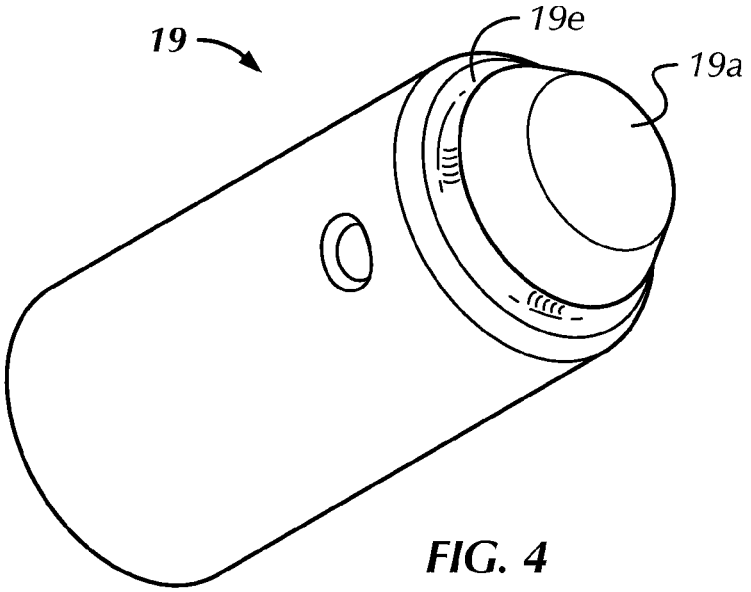
FIG. 4 is a perspective view of a check valve of the DHD hammer of FIG. 1.
Figure 5:
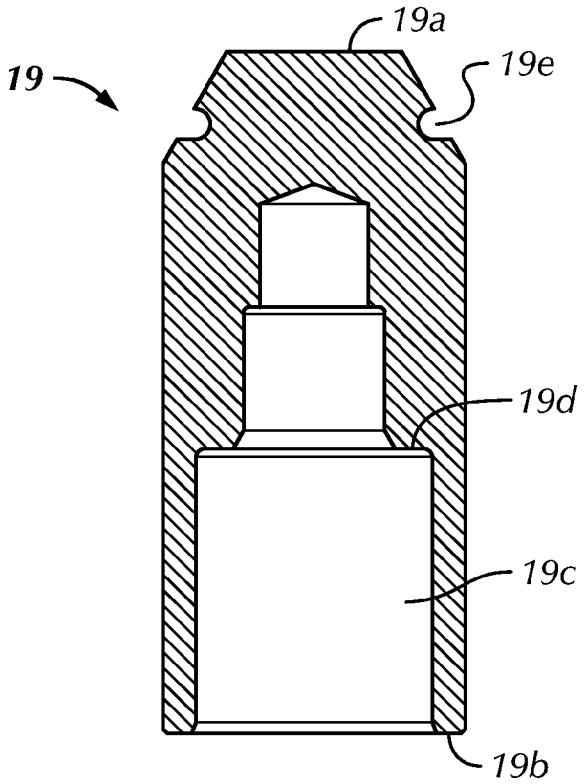
FIG. 5 is a cross-sectional, elevational view of the check valve of FIG. 4.

The check valve assembly 18 (FIG. 11) includes a check valve 19, a biasing member 21, and a distributor 22. The check valve 19 is configured, as best shown in FIGS. 4 and 5, and is operatively assembled to the distributor 22, as best shown in FIG. 11. The check valve 19 includes a closed proximal end 19*a* and an open distal end 19*b*. The check valve 19 also includes an interior 19*c* having a radially inwardly extending distal surface 19*d* about a proximal end of the interior 19*c*. The check valve 19 can also optionally include a gland 19*e* for receiving a seal 19*f* (FIG. 11).

Figure 6:
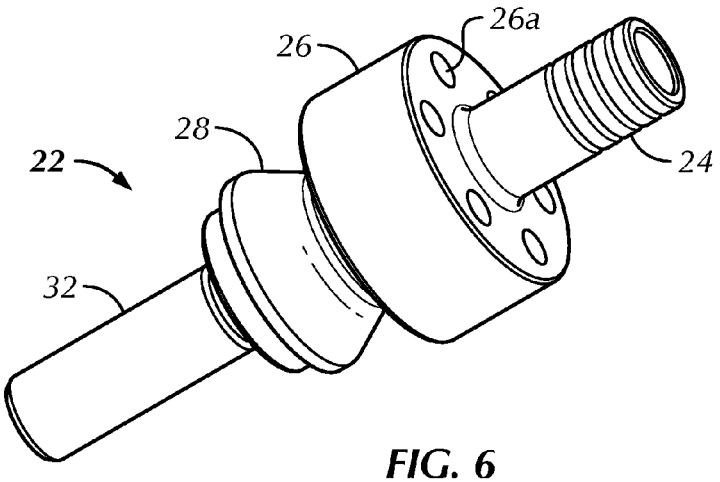
FIG. 6 is a perspective view of a distributor of the DHD hammer of FIG. 1.
Figure 7:
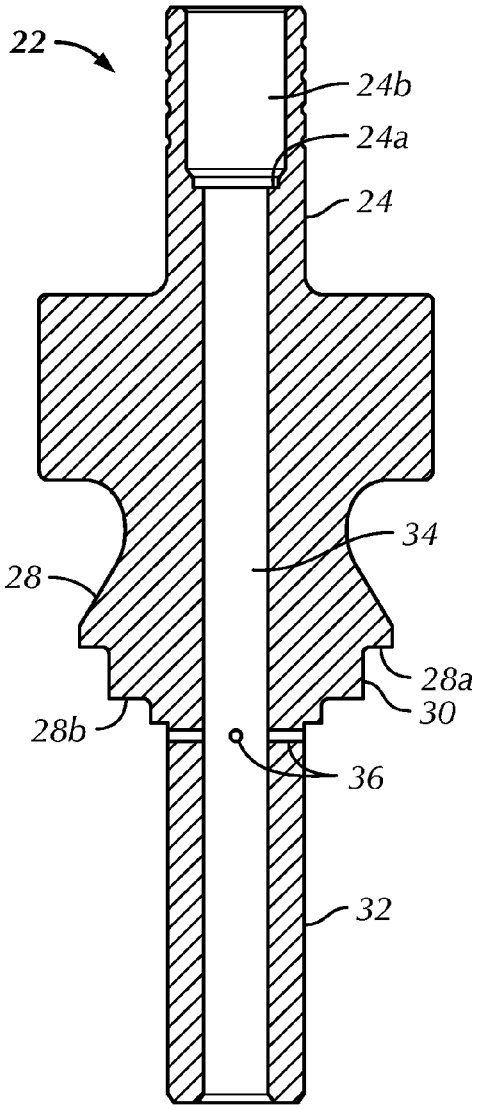
FIG. 7 is a cross-sectional, elevational view of the distributor of FIG. 6.
Figure 8:
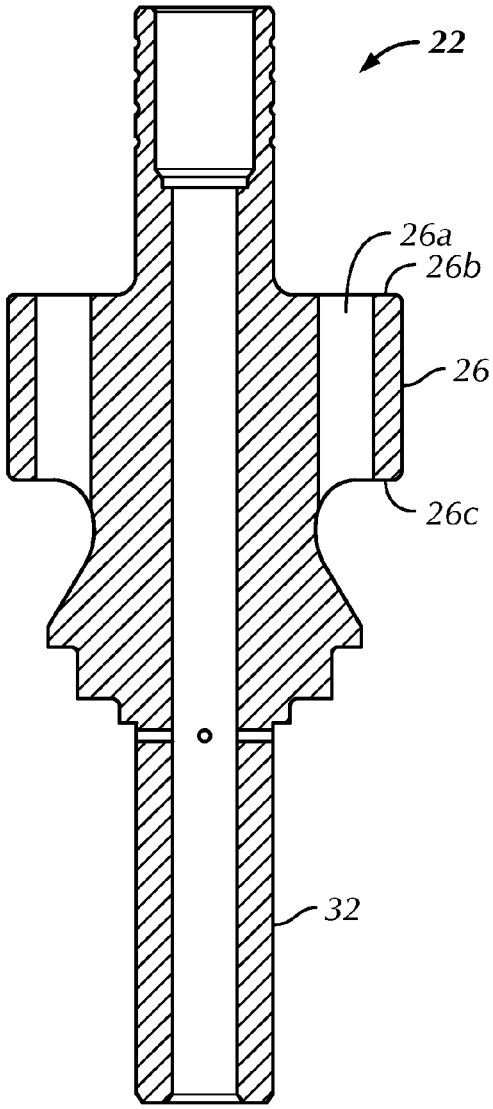
FIG. 8 is a cross-sectional, elevational view of the distributor of FIG. 6 with the cross-section taken through the through holes of the distributor.

The distributor 22 is configured, as best shown in FIGS. 6-8, and is positioned within the housing 12, as best shown in FIG. 11. The distributor 22 includes a stem 24, an upper body portion 26, a lower body portion 28, and an exhaust stem 32. The distributor 22 also includes a central bore 34 and a plurality of apertures 36. The central bore 34 extends axially through the distributor 22 about a central axis of the distributor 22. The plurality of apertures 36 are circumferentially spaced apart and extend in the radial direction from an interior surface of the central bore 34 to an outer surface of the exhaust stem 32 about its proximal end. The plurality of apertures 36 allow for fluid communication radially through the exhaust stem 32.

The stem 24 extends proximally from the upper body portion 26. The stem 24 has an outside diameter that is smaller than the outside diameter of the upper body portion 26. The stem 24 also includes a radially inwardly extending flange 24*a* about a mid portion along the length of the stem 24.

The upper body portion 26 has an outside diameter that is slightly undersized compared to the inside diameter of the housing 12, to fit within the housing 12 without significant play. The upper body portion 26 includes a through hole 26*a* (FIG. 8) extending axially through the upper body portion 26 from a proximal surface 26*b* to a distal surface 26*c* of the upper body portion 26. Preferably, the upper body portion 26 includes a plurality of circumferentially spaced through holes 26*a* and more preferably, six (6) through holes 26*a* that are circumferentially and evenly spaced apart. The through holes 26*a* allow for fluid communication from a region above the upper body portion 26 to a region below the upper body portion 26. The distal surface 26*c* of the upper body portion 26 also engages a proximal end 12*d* of an inner housing 12*a* (also known as and referred to as a cylinder), while the proximal surface 26*b* engages a distal end 16*d* of the backhead 16, when assembled within the housing 12 (FIG. 11). The assembly of the distributor 22 between the proximal end 12*d* of the inner housing 12*a* and the distal end 16*d* of the backhead 16 secures the position of the distributor 22 within the housing 12.

The inner housing 12*a* is a preferably a separate component of the housing 12 that is assembled to the housing 12 in a conventional manner known in the art. However, the inner housing 12*a* can be integrally formed as part of the housing 12 instead of being a separate component assembled thereto.

The lower body portion 28 of the distributor 22 is configured to be substantially frustroconical with a side wall 30 that extends downwardly from a distal surface 28*a* of the frustroconical portion of the lower body portion 28. The lower body portion 28 also includes a distal surface 28*b* that extends radially inwardly from the side wall 30.

The exhaust stem 32 extends distally from a bottom portion of the lower body portion 28. The apertures 36 are located about the proximal end of the exhaust stem 32. Preferably, the exhaust stem 32 includes a plurality of apertures 36 and more preferably, four (4) apertures 36 that are circumferentially and evenly spaced apart.

Referring to FIG. 11, when assembled, the check valve 19 slidingly engages with the stem 24 of the distributor 22. The check valve 19 is biased to a closed position (FIG. 11) to seal off the supply port 20 extending through the backhead 16. The check valve 19 is biased to the closed position by the biasing member 21, such as a compression spring. The biasing member 21 is positioned between the check valve 19 and the stem 24 within an interior 19*c* of the check valve 19 and an interior 24*b* of the stem 24. Specifically, the biasing member 21 has a proximal end that engages the distal surface 19*d* of the check valve 19 and a distal end that engages the radially inwardly extending flange 24*a*.

Figure 9:
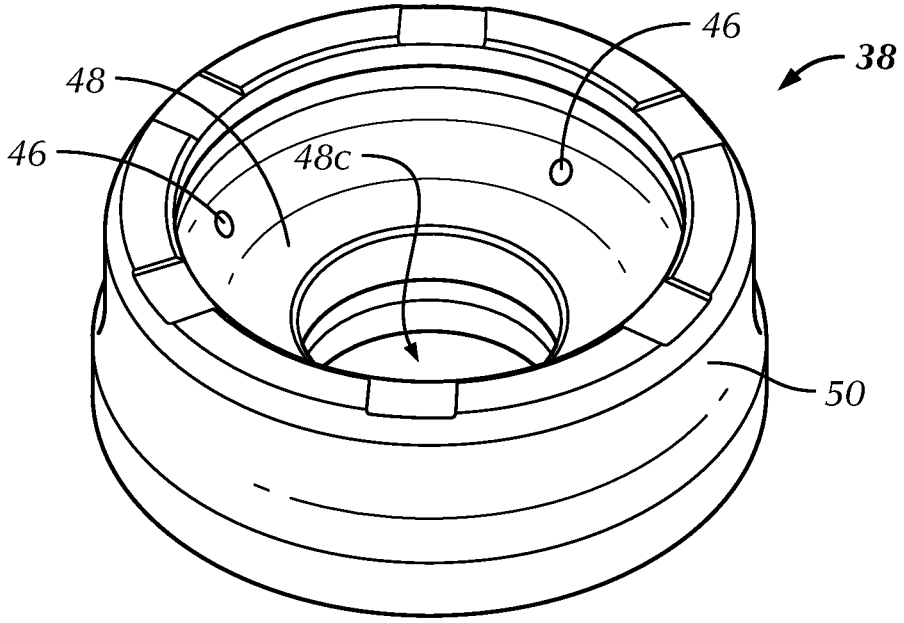
FIG. 9 is an enlarged perspective view of a valve of the DHD hammer of FIG. 1.
Figure 10:
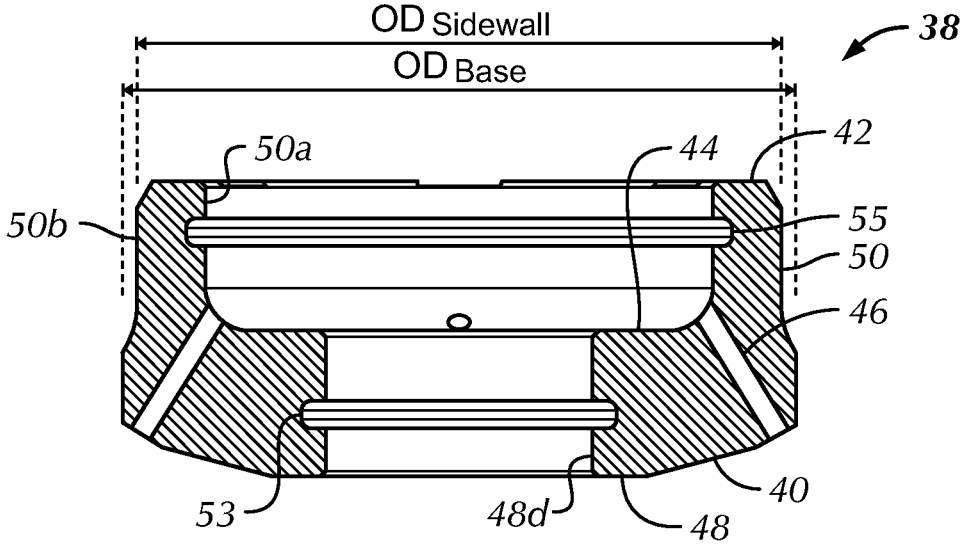
FIG. 10 is a cross-sectional, elevational view of the valve of FIG. 9.
Figure 11:
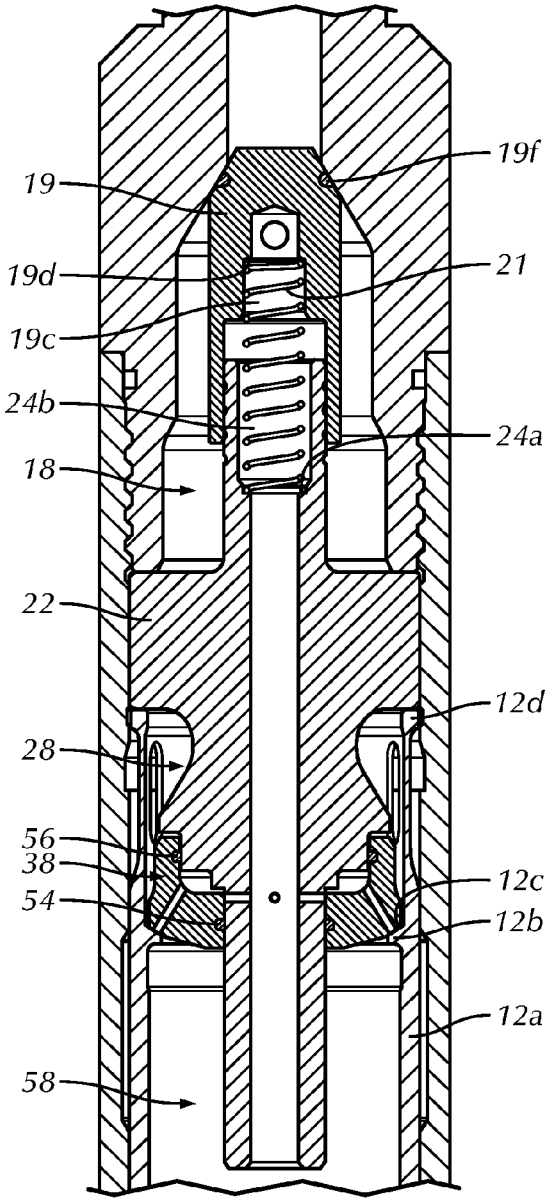
FIG. 11 is a partial, cross-sectional, elevational view of the DHD hammer of FIG. 1 with the check valve in the closed position and a valve in the open position.

The DHD hammer 10 also includes a valve 38, as best shown in FIGS. 9-11. The valve 38 is generally configured as an inverted cap, as shown in FIG. 9 having a substantially "U" shaped cross-section, as shown in FIG. 10. The valve 38 includes a base 48 and a side wall 50 extending from the base 48. The side wall 50 has an inner side surface 50*a* and an outer side surface 50*b*. The base 48 includes a through hole 48*c* that extends through a central portion of the base 48. The valve 38 also includes a first valve pressure surface 40, a second valve pressure surface 42, a third valve pressure surface 44, and a valve passageway 46.

The base 48 can be configured with an overall outside diameter $OD_{base}$ that is substantially the same as the overall outside diameter of the side wall 50 $OD_{side\ wall}$. The base 48, however, is preferably configured with an overall outside diameter $OD_{base}$ that is larger than the overall outside diameter of the side wall 50 $OD_{side\ wall}$. The larger $OD_{base}$ advantageously provides a means to control the rate of flow passing through the first passageway without restricting the flow of working fluids to other areas of the DHD hammer 10 in communication with a volume bounded by the side wall 50.

The first valve pressure surface 40 is a distal surface of the base 48. The first valve pressure surface 40 is also configured to be in communication with the drive chamber 58. The second valve pressure surface 42 is a proximal surface of the side wall 50. The second valve pressure surface 42 is also configured to be in communication with a high pressure port of the DHD hammer 10, as further described below. The third valve pressure surface 44 is a proximal surface of the base 48. The third valve pressure surface 44 is also configured to be in communication with a passageway formed by and extending through the central bore 34 that extends through the distributor 22 via aperture 36 that extends radially through the exhaust stem 32, as further described below.

Figure 14:
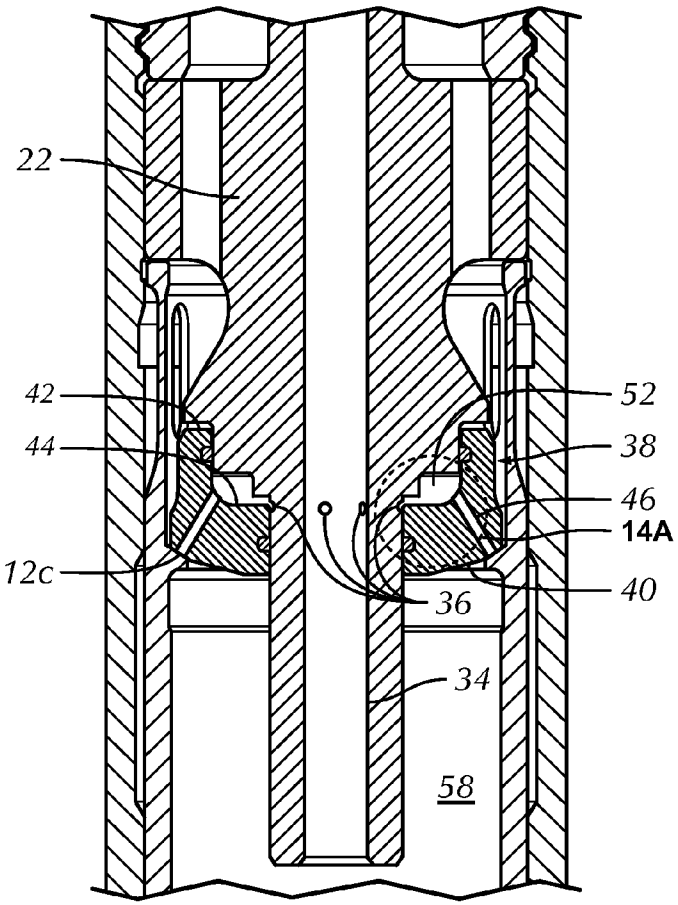
FIG. 14 is an enlarged, partial, cross-sectional, elevational view of the DHD hammer of FIG. 13 with the valve in the closed position and the cross-section taken through the distributor.
Figure 14A:
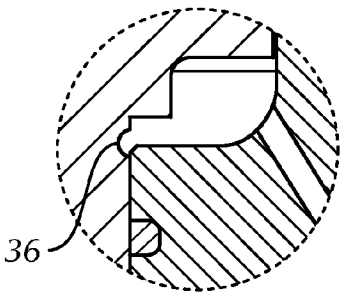
FIG. 14A is a greatly enlarged partial view of the valve/distributor interface of FIG. 14.

The valve passageway 46 is generally configured as a through hole that extends from at least one of an inner side surface 50*a* of the side wall 50 and the third valve pressure surface 44, to the first valve pressure surface 40. That is, the valve passageway 46 includes a proximal end, and a distal end that extends radially outwardly and distally from its proximal end. The distal end of the valve passageway 46 is configured to completely engage with an upper surface 12*c* of the annular rib 12*b* when the valve 38 is in a closed position (FIG. 14). The upper surface 12*c* is an internal surface of the housing 12. Preferably, the valve 38 includes a plurality of valve passageways 46 and more preferably, four (4) valve passageways 46 that are circumferentially and equally spaced apart.

The valve 38 can optionally include a gland 53 about the through hole 48*c* and a gland 55 about an inner side surface 50*a* of the side wall 50. The glands 53 and 55 are configured to receive seals 54, 56 respectively, as shown in FIG. 11. The seals 54, 56 can be e.g., an O-ring seal made from an elastomeric material or any other material readily known in the art suitable for its intended purpose. As shown in FIG. 11, the seal 54 is positioned between the exhaust stem 32 and the base 48 to provide sealing engagement between the base 48 and the exhaust stem 32. The seal 56 is positioned between the side wall 30 of the lower body portion 28 and the side wall 58 of the valve 38 to provide sealing engagement between the side wall 30 and the side wall 58.

The valve 38 is assembled within the DHD hammer 10 and to the distributor 22, as best shown in FIG. 11. The valve 38 and the distributor 22 are located within the housing 12. The housing 12 includes an inner housing 12*a*, that receives the lower body portion 28 of the distributor 22 and the valve 38. The inner housing 12*a* includes an annular rib 12*b* that extends radially inwardly from about an upper region of the inner housing 12*a*. The inner housing 12*a* can e.g., be a cylinder with porting features, as readily known in the art.

The valve 38 is assembled to the distributor 22 such that the through hole 48*c* receives the exhaust stem 32 while the side wall 50 receives the lower body portion 28 of the distributor 22. In the assembled state, the valve 38 is located above the annular rib 12*b*.

Figure 12:
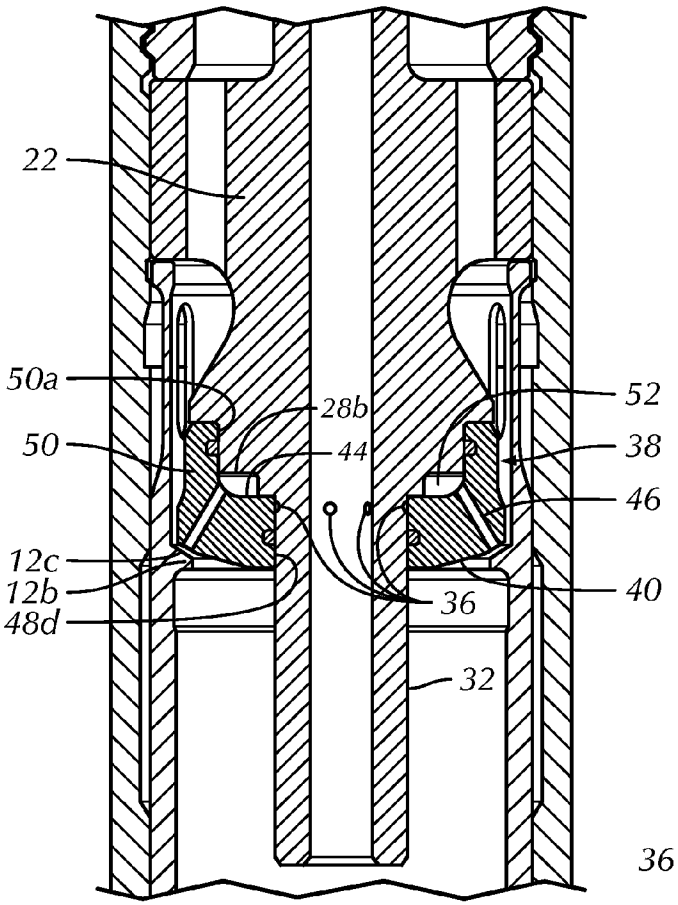
FIG. 12 is an enlarged, partial, cross-sectional, elevational view of the DHD hammer of FIG. 11 with the valve in the open position and the cross-section taken through the through holes of the distributor.

The valve 38 is configured to sealingly engage with the exhaust stem 32 and is movable between an open position (FIG. 11) and a closed position (FIG. 13). In the open position, as best shown in FIG. 12, the drive chamber 58 is in communication with the supply port 20. That is, the valve 38 allows working fluids to flow through the supply port 20, around the check valve assembly 18, down through the through hole 26*a* of the distributor 22 and around the valve 38, passing between the first valve pressure surface 40 and the upper surface 12*c* of the annular rib 12*b* and into the drive chamber 58. The flow path just described represents a first passageway leading from the supply port 20 to the drive chamber 58. The first passageway is also referred to as a high pressure port of the DHD hammer 10, because high pressure working fluids are fed to the DHD hammer 10 therethrough.

Furthermore, in the open position, the valve 38 is sealingly engaged with the exhaust stem 32 such that an upper portion of the inner side surface 48*d* sealingly engages apertures 36 of the exhaust stem 32. That is, the inner side surface 48*d* completely covers the plurality of apertures 36.

The assembly of the valve 38 to the distributor 22 also forms a first volume 52 that is bounded by the valve 38 and a distal surface 28*b* of the distributor 22. The first volume 52 is in communication with the valve passageway 46. Further, in the open position, the first volume 52 is in communication with the drive chamber 58 via the valve passageway 46.

The first volume 52 and cross-sectional flow area through the valve passageway 46 is preferably configured to have a ratio of [volume (inches$^3$)]:[area (inches$^2$)] of about 20 to 40. It is this ratio that advantageously allows a user to adjust and control the timing of the opening and closing of the valve 38 and therefore, control and adjust the overall efficiency of the DHD hammer 10. The cross-sectional flow area through the valve passageway 46 can be adjusted, for example, by increasing the number of valve passageways 46 formed through the valve 38 or by adjusting the overall diameter of an individual valve passageway 46.

When in the closed position, as best shown in FIG. 14, the high pressure port is sealed off from the drive chamber 58. That is, the valve 38 moves distally until the first valve pressure surface 40 engages with the upper surface 12*c* of the annular rib 12*b* i.e., an internal surface of the housing 12. In this position, the first passageway is closed off and the distal end of the valve passageway 46 is sealed off by the upper surface 12*c*. Furthermore, the proximal end of the base 48 moves distally to partially expose the apertures 36, thereby allowing communication between the first volume 52 and the central bore 34 of the distributor 22. That is, the second passageway permits communication between the first volume 52 and the drive chamber 58 when the valve 38 is in the closed position. The apertures 36 advantageously allow for the release of pressurized working volumes within the first volume 52 to be discharged through the distributor 22, such that the valve 38 can be moved proximally and repositioned to the open position, as further described below.

The assembly of the valve 38 and the distributor 22 provides the first passageway permitting fluid communication between the high pressure port and the drive chamber 58, as described above. The assembly of the valve 38 and the distributor 22 also provides a second passageway permitting fluid communication between the first volume 52 and the drive chamber 58 when the valve 38 is in the open position. The second passageway extends through the valve passageway 46. Lastly, the assembly of the valve 38 and the distributor 22 provides for a third passageway permitting fluid communication between the first volume 52 and the central bore 34 of the distributor 22, when the valve 38 is in the closed position. The third passageway extends through the aperture 36.

In operation, the piston 14 (as best shown in FIG. 13) moves reciprocatively within the DHD hammer 10, as a result of the operation of the valve 38 and working fluid volumes supplied to the DHD hammer 10 via the supply port 20 and first passageway. Specifically, the piston 14 cycles between a return position, wherein the piston 14 is at its most proximal position within the DHD hammer 10, and an impact position, wherein the distal end of the piston 14 impacts the drill bit 13. The movement of the piston 14 from the impact position to the return position is referred to as the return cycle. The movement of the piston 14 from the return position to the impact position is referred to as the drive cycle.

During the return cycle, the vale 38 is in the closed position. However, as the piston 14 reaches the return position during the return cycle, the pressure within the drive chamber 58 builds up owing to the decreased volume or volume contraction of the drive chamber 58 during the return cycle. This pressure build up applies forces on the first valve pressure surface 40 to move the valve 38 to the open position.

When the valve 38 moves to the open position, the first passageway opens up to provide high pressure working volumes to the drive chamber 58 and drive the piston 14 towards the impact position (i.e., initiation of the drive cycle). As the piston 14 moves distally during the drive cycle, the drive chamber 58 is pressurized via the first passageway and the first volume 52 is pressurized via the second passageway. However, the first volume 52 is significantly smaller than the drive chamber 58 volume and thus pressurizes at a faster rate than the drive chamber 58. Moreover, as the piston 14 moves distally, the drive chamber 58 volume expands, and once the piston 14 moves past the distal end of the exhaust stem 32, the pressure within the drive chamber 58 exhausts through the piston's central bore. The resulting combination of the expanding drive chamber 58 volume and subsequent exhausting of the drive chamber 58 fluids results in a pressure differential between the pressure within the first volume 52 and the pressure within the drive chamber 58 to move the valve 38 from the open position to the closed position (FIG. 13). Owing to the configuration of the first volume 52, the rate of flow through the valve passageway 46 or the overall cross-sectional flow area through the valve passageway 46, and the drive cycle of the piston 14, the valve 38 closes after the piston 14 moves distally about 50% to 90%, and preferably, about 70% to 80% of the total drive cycle length. Then, after the piston 14 reaches the impact position, the drive and return cycles repeat with the foregoing described opening and closing of the valve 38.

Figure 15:
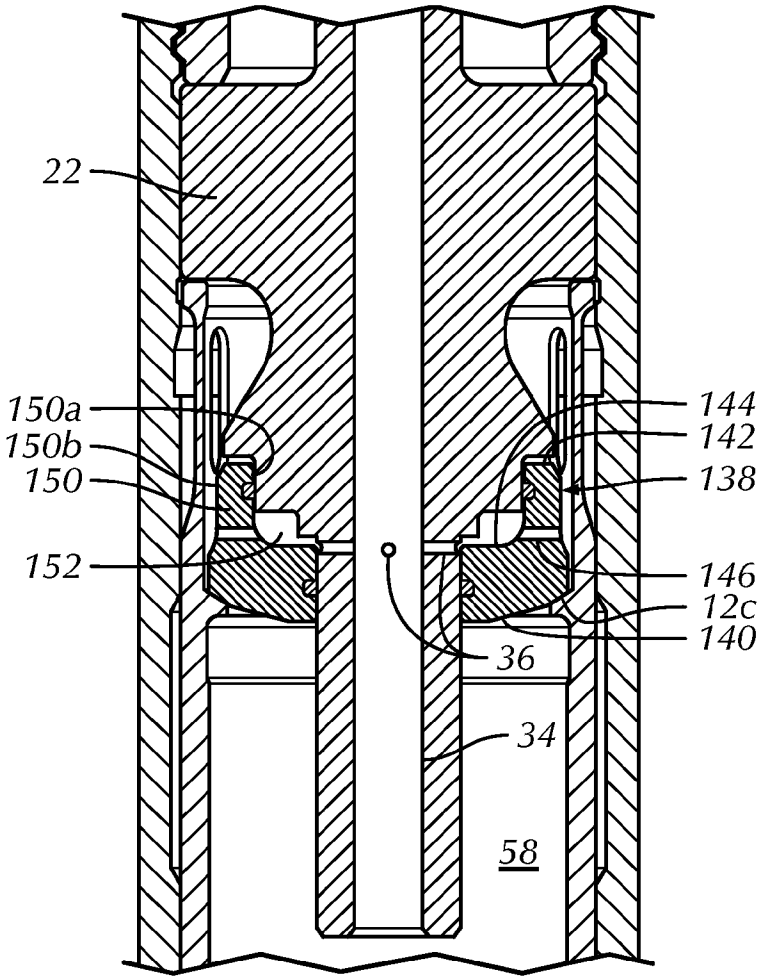
FIG. 15 is an enlarged, partial, cross-sectional, elevational view of a valve and a distributor of a DHD hammer in accordance with a second preferred embodiment.

FIG. 15 illustrates a valve 138 in accordance with a second preferred embodiment of the present invention. The valve 138 is configured substantially the same as the valve 38 of the first preferred embodiment, except for a valve passageway 146. The valve passageway 146 is configured to extend from at least one of the third valve pressure surface 144 and an inner side surface 150*a* of side wall 150 to an outer side surface 150*b* of the valve 138. Preferably, the valve passageway 146 is a substantially horizontal valve passageway. The valve passageway 146 allows fluid communication between a first volume 152 and the high pressure port when the valve 138 is in either a closed or open position.

Figure 16:
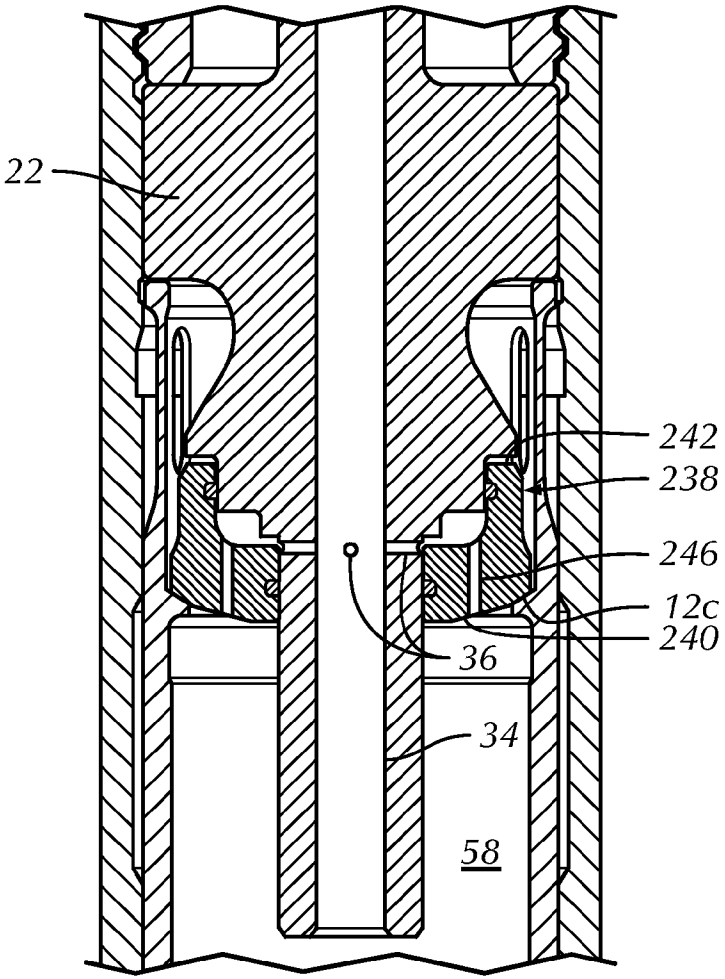
FIG. 16 is a enlarged, partial, cross-sectional, elevational view of a valve and a distributor of a DHD hammer in accordance with third preferred embodiment of the present invention.

FIG. 16 illustrates a valve 238 in accordance with a third preferred embodiment of the present invention. The valve 238 is configured substantially the same as the valve 38 and the valve 138 of the first and second preferred embodiments, except for a valve passageway 246. The valve passageway 246 is configured to extend from at least one of a third valve pressure surface 244 and an inner side surface 250*a* of the valve 238 and a distal end of the valve 238. That is, the valve passageway 246 extends to the first valve pressure surface 240. Preferably, the valve passageway 246 is a substantially vertical passageway or parallel to the central bore 34 of the distributor 22. As such, the valve passageway 246 allows for fluid communication between a first volume 252 to the drive chamber 58 when the valve 238 is in either in a closed or an open position. That is, the distal end of the valve passageway 246 is positioned spaced apart from the upper surface 12*c* of the annular rib 12*b*, such that the valve passageway 246 is not sealed or covered by the inner housing 12*a* when in the closed position.

The operation of the valves 138, 238 of the second and third preferred embodiments operates substantially the same as the valve 38 of the first preferred embodiment.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A down-the-hole drilling apparatus comprising:

a housing;

a drill bit situated about a distal end of the housing;

a piston having a distal end for impacting the drill bit and housed within the housing; and a pressure reversing valve that includes:

a first valve pressure surface for engaging an internal surface of the housing and in communication with a drive chamber of the down-the-hole drilling apparatus;

a second valve pressure surface in communication with a high pressure port of the down-the-hole drilling apparatus;

a third valve pressure surface in communication with a passageway extending through a distributor within the housing; and a valve passageway extending through the pressure reversing valve and in communication with a first volume of the down-the-hole drilling apparatus, wherein the first volume is formed by surfaces of the distributor and the third valve pressure surface.

2. The apparatus of claim 1, wherein the internal surface of the housing is a radially inwardly extending portion of the housing.

3. The apparatus of claim 1, wherein the first valve pressure surface includes a distal surface and the third valve pressure surface includes a proximal surface.

4. The apparatus of claim 3, wherein the valve passageway extends from at least one of the third valve pressure surface to the first valve pressure surface.

5. A pressure reversing valve for a down-the-hole drilling apparatus comprising:

a first valve pressure surface for engaging an internal surface of a housing of the down-the-hole drilling apparatus and in communication with a drive chamber of the down-the-hole drilling apparatus;

a second valve pressure surface in communication with a high pressure port of the down-the-hole drilling apparatus;

a third valve pressure surface in communication with a passageway extending through a distributor within the housing;

a valve passageway extending through the pressure reversing valve and in communication with a first volume of the down-the-hole drilling apparatus, wherein the first volume is formed by surfaces of the distributor and the third valve pressure surface;

a first passageway permitting fluid communication between the high pressure port and the drive chamber; and a second passageway permitting fluid communication between the first volume and the drive chamber.

6. The pressure reversing valve of claim 5, wherein the pressure reversing valve is configured to move between an open position, wherein the first passageway permits fluid communication between the high pressure port and the drive chamber, and a closed position, wherein the first pressure surface engages the internal surface of the housing preventing fluid communication within the first passageway between the high pressure port and the drive chamber.

7. The pressure reversing valve of claim 6, wherein the valve passageway is in communication with the drive chamber and is sealed by the internal housing surface when the pressure reversing valve is in the closed position.

8. The pressure reversing valve of claim 6, wherein the valve passageway is in communication with the first volume and the drive chamber when the pressure reversing valve is in the open or closed position.

9. The pressure reversing valve of claim 6, wherein the valve passageway is in communication with the first volume and the high pressure port when the pressure reversing valve is in the open or closed position.

10. The pressure reversing valve of claim 6, wherein the second passageway permits communication between the first volume and the drive chamber when the pressure reversing valve is in the closed position.

11. A pressure reversing valve assembly for a down-the-hole drilling apparatus comprising:

a housing;

a drill bit situated about a distal end of the housing;

a piston having a distal end for impacting the drill bit and housed within the housing;

a distributor within the housing, the distributor including;

an exhaust stem, a central bore extending axially through the distributor, and a plurality of apertures extending radially through the exhaust stem; and a valve sealingly engaged with the exhaust stem and movable between an open position, wherein a high pressure port is in communication with a drive chamber, and a closed position, wherein the high pressure port is sealed off from the drive chamber, the valve including;

a first valve pressure surface, a second valve pressure surface, a third valve pressure surface, and a valve passageway extending through the valve and in communication with a first volume of the down-the-hole drilling apparatus, wherein the first volume is formed by surfaces of the distributor and at least one of the first, second and third valve pressure surfaces.

12. The pressure reversing valve assembly of claim 11, wherein the valve passageway is sealed when in the closed position.

13. The pressure reversing valve assembly of claim 11, wherein the valve passageway is in communication with the first volume and the drive chamber when the valve is in the open or closed position.

14. The pressure reversing valve assembly of claim 11, wherein the valve passageway is in communication with the first volume and the high pressure port when the valve is in the open or closed position.

15. A pressure reversing valve assembly comprising:

a distributor that includes;

an upper body portion, and a lower body portion having a side wall, and an exhaust stem extending distally from the lower body portion; and a valve that includes:

a base having a proximal surface, a distal surface and a thru hole for receiving the exhaust stem, a side wall extending from the base, the side wall having an inner side surface and an outer side surface, and a valve passageway extending through the valve and in communication with an area formed by the distributor and the proximal surface of the base.

16. The pressure reversing valve assembly of claim 15, wherein the base of the valve sealingly engages the exhaust stem and the inner side surface of the side wall of the valve sealingly engages the side wall of the lower body portion of the distributor.

17. The pressure reversing valve assembly of claim 15, wherein the valve passageway extends from at least one of the proximal surface of the base and the inner side surface of the side wall to the distal surface of the base.

18. The pressure reversing valve assembly of claim 15, wherein the valve passageway extends from the inner side surface to the outer side surface of the side wall of the valve.

19. The pressure reversing valve assembly of claim 15, wherein the valve passageway extends in a direction from at least one of the proximal surface of the base and the inner side surface of the side wall radially outwardly and distally.

20. The pressure reversing valve assembly of claim 15, further comprising a first seal positioned between the central thru hole of the base and the exhaust stem, and a second seal positioned between the side wall of the lower body portion and the side wall of the valve.

* * * * *